United States Patent [19]

Deutsch et al.

[11] 4,385,542

[45] May 31, 1983

[54] ACOUSTIC TONE SYNTHESIZER FOR AN ELECTRONIC MUSICAL INSTRUMENT

[75] Inventors: Ralph Deutsch, Sherman Oaks; Leslie J. Deutsch, Sepulveda, both of Calif.

[73] Assignee: Kawai Musical Instrument Mfg. Co., Ltd., Hamamatsu, Japan

[21] Appl. No.: 304,535

[22] Filed: Sep. 22, 1981

[51] Int. Cl.[3] ..... G10H 1/08; G10H 7/00

[52] U.S. Cl. ..... 84/1.23; 84/1.22

[58] Field of Search ..... 84/1.01, 1.11, 1.12, 84/1.19–1.23

[56] References Cited

U.S. PATENT DOCUMENTS

| | | | |
|---|---|---|---|
| 3,591,699 | 7/1971 | Cutler | 84/1.11 |
| 3,651,242 | 3/1972 | Evans | 84/1.11 |
| 4,282,790 | 8/1981 | Wachi | 84/1.21 |
| 4,313,360 | 2/1982 | Faulkner | 84/1.21 |

*Primary Examiner*—Stanley J. Witkowski

*Attorney, Agent, or Firm*—Ralph Deutsch

[57] ABSTRACT

In a musical instrument having one or more tone generators in which a plurality of data words corresponding to the amplitudes of points defining the waveform of a musical tone are computed and transferred to a digital-to-analog converter to be converted into musical waveshapes, apparatus is provided for generating tones which are imitative of acoustic signals created by singing or humming. A new tone is obtained by singing into a microphone and actuating a switch. The output waveshapes are generated by implementing a Fourier transform algorithm using a set of harmonic coefficients determined by sampling and processing the signal produced by the microphone.

21 Claims, 9 Drawing Figures

ACOUSTIC TONE SYNTHESIZER FOR AN ELECTRONIC MUSICAL INSTRUMENT

BACKGROUND OF THE INVENTION

1. Field of the Invention

This invention relates to electronic tone synthesis and in particular is concerned with a means for generating tones from acoustic sources.

2. Description of the Prior Art

Various attempts have been made for many years to construct apparatus for imitating the human singing voice. The early theatre pipe organs had a solo stop called the Vox Humana (human voice). This stop was implemented as a rank of reed pipes which only remotely reminded one of sound of human origin.

Vocoder-type implementations have been used to produce human-like sounds. To obtain a singing quality a microphone is used to convert a real human singing tone into an electrical signal. By means of a frequency follower, the fundamental frequency of the input signal can be tracked and then transposed to musical pitches in response to the actuation of keyboard switches. The resultant sounds, while not an exact replica of the input sound, have a human-like tone quality.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. During a computation cycle, a master data set is created by implementing a discrete Fourier transform using a set of harmonic coefficients which characterize the generated output musical sounds. The computations are carried out at a fast rate which may be nonsynchronous with any musical frequency. At the end of a computation cycle, the master data set is stored in a memory.

Following a computation cycle, a transfer cycle is initiated during which the stored master data set is transferred to preselected members of a multiplicity of tone generators. The output tone generation continues uninterrupted during the computation and transfer cycles. The transferred data are stored in a note register contained in a tone generator. The master data set stored in the note registers in each of the preselected members of the multiplicity of tone generators is sequentially and repetitively read out of storage and converted to an analog musical waveshape by means of a digital-to-analog converter. The memory addressing rate is proportional to the corresponding fundamental frequency of the musical pitch associated with a tone generator.

New tones are introduced into the tone generation system by singing, or humming, into a microphone. The input analog signal data is converted into digital data words by the application of an analog-to-digital converter. A selected sample length of the converted data is processed by a discrete Fourier-type computational system to provide a set of harmonics which are stored to be used in the computation of the master data set.

It is an object of the present invention to quickly change generated musical tones by merely singing a new tone.

It is a further object of the invention to create new tones without an intermediate step of determining the pitch of the input audible tone.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed to a subsystem for obtaining harmonic coefficients from an external source and which is incorporated into a musical tone generator of the type which synthesizes musical waveshapes by implementing a discrete Fourier transform algorithm. A tone generation system of this type is described in detail in U.S. Pat. No. 4,085,644 entitled "Polyphonic Tone Synthesizer" which is hereby incorporated by reference. In the following description all the elements of the system which are described in the referenced patent are identified by two digit numbers which correspond to the same numbered elements appearing in the referenced patent. All system element blocks which are identified by three digit numbers in the 200 numerical series correspond to elements added to the Polyphonic Tone Synthesizer to implement the improvements of the present invention to produce an acoustic tone synthesizer. The 100 numerical series denote combination of functional elements of the Polyphonic Tone Synthesizer.

Figure 1:
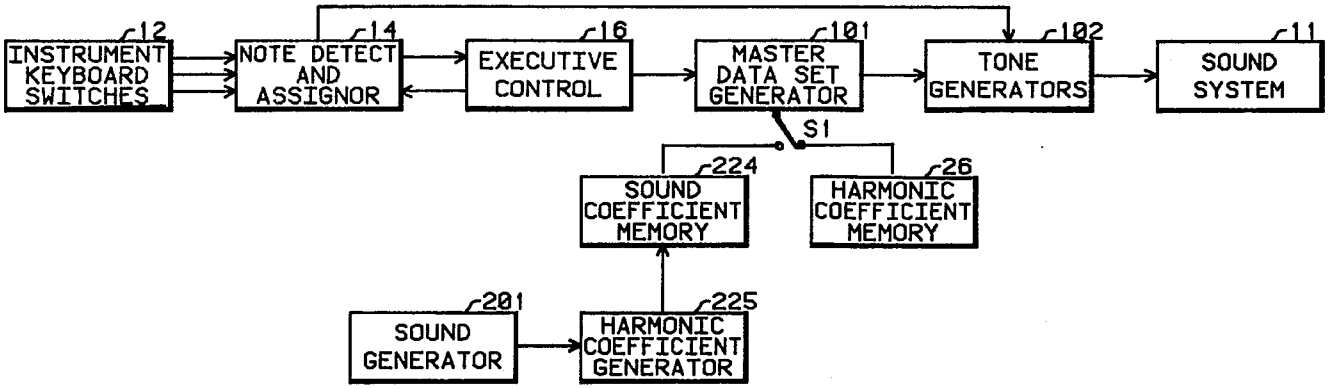
FIG. 1 is a schematic diagram of an embodiment of the invention.

FIG. 1 shows an embodiment of the present invention which is described as a modification and adjunct to the system described in U.S. Pat. No. 4,085,644. As described in the referenced patent, the Polyphonic Tone Synthesizer includes an array of switches contained in the block labeled instrument keyboard switches 12 which, for example, corresponds to the conventional keyboard switch array of an electronic musical instrument such as an organ. By depressing one or more keys on the instrument's keyboard, a note detect and assignor circuit 14 stores the note information for the keys that have been actuated and assigns each actuated keyswitch to one of twelve separate and independent tone generators. The set of tone generators is contained in the system block labeled tone generators 102. A suitable note detect and assignor circuit is described in U.S. Pat. No. 4,022,098 which is hereby incorporated by reference. When one or more keys on the keyboard has been depressed, or actuated, an executive control circuit 16 initiates a computation cycle during which a master data set consisting of 64 data words is computed by means of the master data set generator 101 and stored in a memory. The 64 data words are generated having values which correspond to the amplitudes of 64 equally spaced points for one cycle of the audio waveform for the musical tone produced by the tone generators. The general rule is that the maximum number of harmonics in the audio tone spectra is no more than one half of the number of data points in one complete waveshape cycle, or equivalently the number of data points comprising the master data set.

At the completion of a computation cycle, a transfer cycle is initiated during which the master data set stored in the memory is read out and transferred to note registers which are elements of each member of the set of tone generators 102. These note registers store the 64 data words which correspond to one complete cycle of a preselected musical tone. The data words stored in the note registers are read out sequentially and repetitively and transferred to a digital-to-analog converter which converts the digital data words into an analog musical waveshape which is then transferred into an audible sound by means of a sound system 11 consisting of a conventional amplifier and speaker subsystem. The stored data is read out of each note register at a rate corresponding to the fundamental frequency of the note corresponding to the actuated keyswitch to which a tone generator has been assigned.

As described in the above-identified U.S. Pat. No. 4,085,644, it is desirable to be able to continuously recompute and store the generated master data set during a sequence of computation cycles and to load this data set into the note registers while the actuated keys remain depressed on the keyboard. This function is accomplished without interrupting the flow of data points to the digital-to-analog converter at the read-out clock rates.

Switch S1 is used to select harmonic coefficient values to be used by the master data set generator 101 to compute the master data set. When switch S1 is to the left, the harmonic coefficient values stored in the harmonic coefficient memory 26 are transmitted to the master data set generator 101. When switch S1 is to the right, the harmonic coefficient values stored in the sound coefficient memory 224 are selected and transferred to the master data set generator 101.

The harmonic coefficient generator 225, in a manner described below, receives tones produced by the sound generator 201 and processes the received signals to evaluate a set of harmonic coefficients which are stored in the sound coefficient memory 224.

Figure 2:
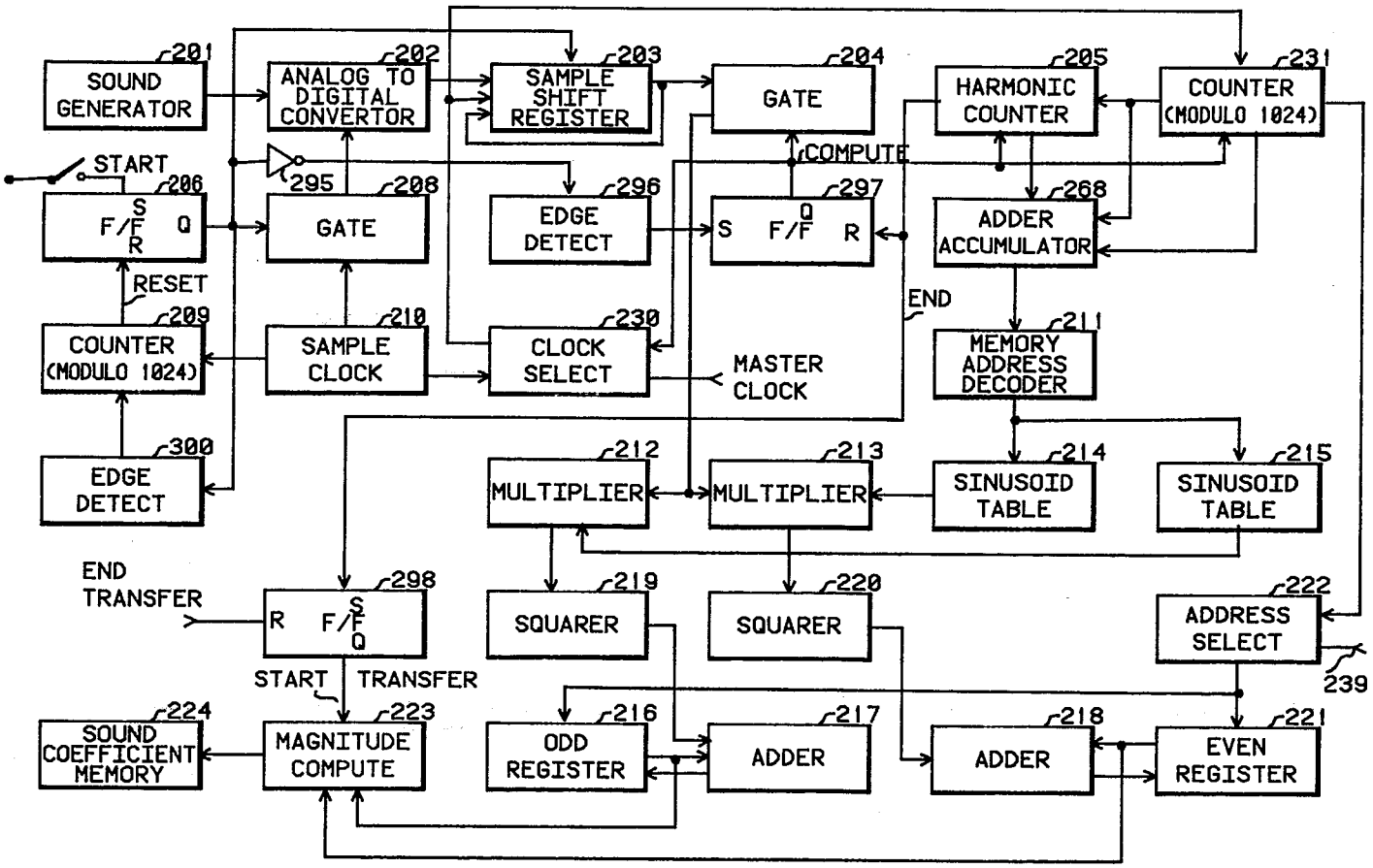
FIG. 2 is a schematic diagram of the harmonic coefficient generator of FIG. 1.

FIG. 2 illustrates the detailed logic of the harmonic coefficient generator 225 shown in FIG. 1. The sound generator 201 can be any convenient source of analog tone signals. A preferred embodiment is to implement the sound generator as a microphone followed by an amplifier. The sounds received by the microphone are converted into signals which serve as the output of the sound generator 201. For purposes of explaining the operation of the present invention a "musical tone" or "musical signal" is used as generic terms for periodic signals or signals having a fundamental frequency which varies slowly with time.

It is assumed that the pitch of the input musical tone to the microphone in the sound generator 201 lies in the musical range of $c_3$ to $C_5$. Moreover, a realistic assumption is to assume that the input musical tones are limited to not more than 16 harmonics. These assumptions are consistent with tones produced by singing or humming and do not represent an inherent limitation or restriction of the present invention. It will be apparent that changes can be readily made in the various sampling and memory systems to accomodate any range of musical frequencies and the maximum number of harmonics associated with an input tone.

Advantageously the sound generator 201 contains a low pass filter so that frequencies exceeding the 16th harmonic of $C_5$, or $1046.5\times16=16.7$ khz, are attenuated and are essentially eliminated and are not transferred to the analog-to-digital converter 202.

The analog-to-digital converter 202 converts the analog signal provided by the sound generator 201 into a sequence of digital words. For an upper frequency limit of the 16th harmonic of the musical note $C_5$, the analog-to-digital converter 202 must operate at a sampling rate is more than the Nyquist sampling rate which for this upper frequency bound is $f_s=1046.5\times16\times2=33.4$ khz. Advantageously the sampling frequency should be somewhat greater than the Nyquist frequency. A choice of about 1.2 to 1.8 times the Nyquist frequency is often used in sampled data systems.

As a general "rule of thumb," it is desirable to have a data sample of about 4 complete periods of a periodic waveshape available for a data processor intended to extract harmonic spectral data values. In the preferred embodiment, a data set of $N=1024$ points is used. This value of N provides a data sample of 4 periods for a tone at the lower frequency limit of a tone at the pitch of $C_3$ and a data sample of 16 periods at the upper frequency limit of a tone at the pitch of $C_5$.

When a new set of harmonic coefficients are to be generated and stored in the sound coefficient memory, a START signal is generated by means of a switch actuated by the musician. The START signal sets the flip-flop 206 so that its output logic state is Q="1". In response to the logic state Q="1", gate 208 causes the timing signals created by the sample clock 210 to be transferred to operate the analog-to-digital converter 202. The state Q="1" causes the counter 209 to be reset to its initial value, or initial count state by the action of the edge detect 304. The counter 209 is implemented to count modulo 1024. This counter is incremented in response to the timing signals generated by the sample clock 210. The sample clock 210 is a source of timing signals that has a frequency at least equal to the Nyquist sampling frequency as previously described.

The digital data samples produced by the analog-to-digital converter 202 are stored in the sample shift register 203. When counter 209 is incremented to its maximum count state of 1024, a RESET signal is generated. In response to the RESET signal, flip-flop 206 is reset so that its output is the logic state Q="0". In response to a logic state Q="1", the sample shift register 203 will store the sequence of digital data values provided at the output of the analog-to-digital converter 202. In response to a logic state of Q="0", the sample shift register 203 operates in a conventional end-around data circulation mode for a shift register.

Advantageously the harmonic coefficients for the input tone from the sound generator 201 are computed for a dynamic range of 36 db. This range of values is provided by implementing the analog-to-digital converter 202 to convert to digital words having at least 7 bits. 8 bits is a good choice because there are many commercially available data converters having an 8 bit resolution.

At the completion of a data acquisition mode initiated by the START signal, the logic state Q="0" is inverted to a logic "1" signal by the inverter 295 and causes a compute mode to be initiated. During the compute mode, a set of harmonic coefficients $c_q$ are evaluated corresponding to the data values $x_n$ stored in the sample shift register 203 according to the relations $$c_q=(a_q^2+b_q^2)^{\frac{1}{2}} \quad \text{Eq. 1}$$

where $$a_q = \sum_{n=1}^{N} x_n \sin(2\pi nq/N) \quad \text{Eq. 2}$$

$$b_q = \sum_{n=1}^{N} x_n \cos(2\pi nq/N) \quad \text{Eq. 3}$$

$x_n$ represents the data samples obtained by the analog-to-digital conversion of the signal produced by the sound generator 201. N is the total number of data points stored in the sample shift register 203. The harmonic coefficients $c_q$ are harmonics corresponding to a normalized fundamental frequency of 1/N. It is not the $c_q$ coefficients that are stored in the sound coefficient memory, but rather a subset of the $c_q$ are selected in a manner to be described. The $c_q$ are called the normalized harmonic coefficients.

Figure 3:
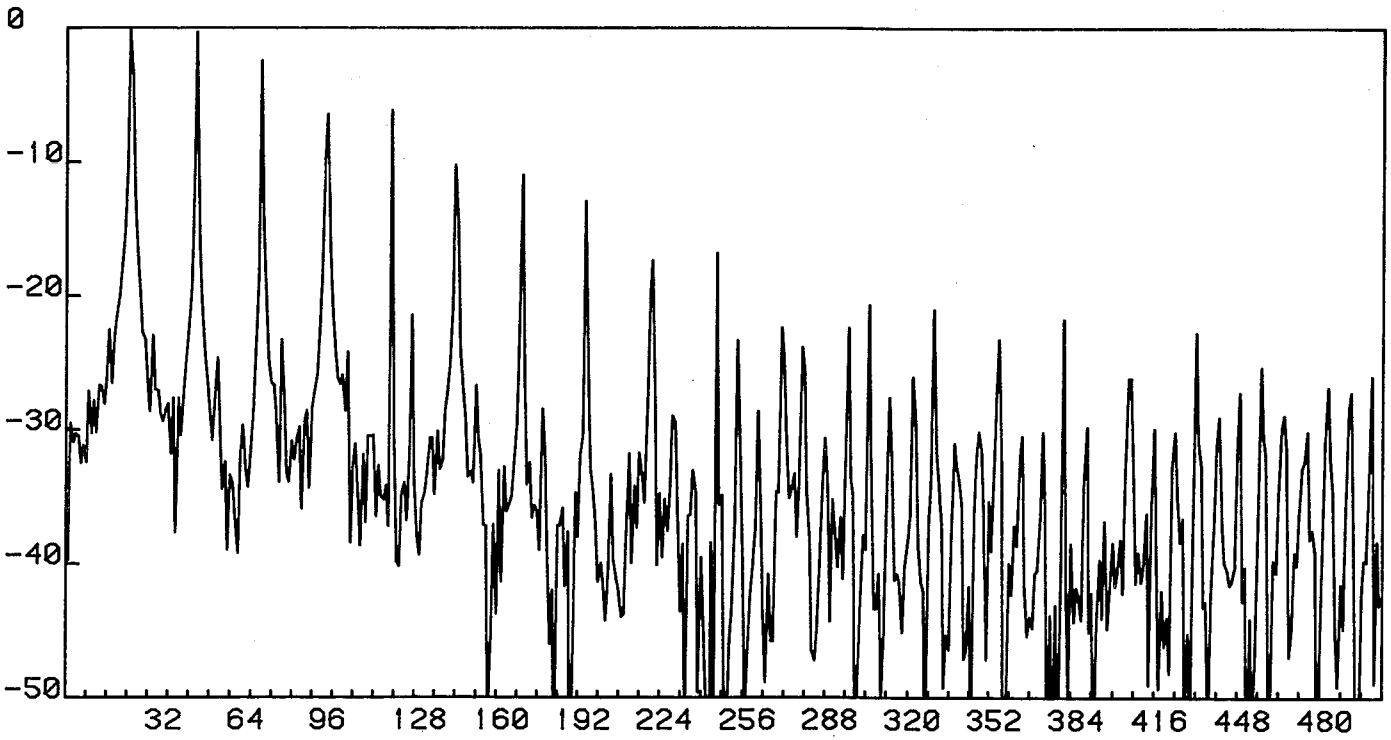
FIG. 3 is a spectral graph corresponding to a typical musical waveshape.

FIG. 3 illustrates a spectral response corresponding to a typical musical waveshape to which some noise was added. The ordinate scale is marked in steps of −5 db. The abscissa is marked in steps of the normalized frequency 1/N. The curve is a plot of the normalized harmonic coefficient $c_q$ expressed in db units relative to a maximum of db. The desired subset of the coefficients $c_q$ are the first 16 regularly spaced peaks of the complete spectra.

The signal output from the inverter 295 is converted into a short pulse by means of the edge detect 296. This pulse is used to set the flip-flop 297. When this flip-flop is set, the system is in its compute mode of operation.

During the compute mode, the signal from the flip-flop 297 causes the clock select 230 to select the system master clock to advance data in the sample shift register. The master clock times the logic in the data processing system elements. Advantageously the master clock can operate at a frequency greater than that of the sample clock 210. As noted previously, the frequency of the sample clock 210 is determined by the highest frequency component expected from a signal output from the sound generator 201.

Both the harmonic counter 205 and the counter 231 are initialized to their initial count states at the start of the compute mode in response to a transition to a logic "1" output state from the flip-flop 297.

The counter 231 is incremented by the master clock timing signals which are selected by the clock select 230 for the system's compute mode. Counter 231 is implemented to count modulo 1024 which is equal to the number of data points stored in the sample shift register 203. Each time the counter 231 is incremented to its initial state because of its modulo counting action, a reset signal is generated which is used to increment the count state of the harmonic counter 205.

The harmonic counter 205 is implemented to count modulo 512. In the general case, if the counter 231 counts modulo N, where N is the number of data values stored in the sample shift register 203, then the harmonic counter 205 counts modulo [N/2]. [N/2] denotes the greatest integer value not exceeding N/2.

The adder-accumulator 208 successively adds the count state of the harmonic counter 205 to itself in response to changes in the count state of the counter 231. The adder-accumulator 208 is initialized by the reset signal generated by the counter 231.

The memory address decoder 211 is used to address data from the sinusoid tables 214 and 215 in response to the contents of the adder-accumulator 208. Sinusoid table 214 is implemented as a memory storing values of sin (2πk/1024) and sinusoid table 215 is implemented as a memory storing values of cos (2πk/1024) for values of k=1, 2, . . . , 1024. Instead of storing a complete period of 1024 points, both memories can be reduced to a quarter-period of 256 points by implementing the memory address decoder 211 to utilize the known symmetrical properties of the trigonometric sine and cosine functions. Such table addressing techniques are well-known in the signal processing art.

The data transferred by the gate 204 during the compute mode is multiplied by the trigonometric value addressed out from the sinusoid table 214 by means of the multiplier 213. Similarly the same data is multiplied by the trigonometric value addressed out from the sinusoid table 215 by means of the multiplier 212.

During the compute mode, data is read out of, and written into, the odd register 216 and the even register 221 at an address corresponding to the count state of the counter 231. The address data for these two registers is selected by means of the address select 222.

The data value output from the multiplier 212 is squared by means of the squarer 219 and added to a data value read out of the odd register 216 by means of the adder 217. The sum is stored in the odd register 216. Similarly, the data value output from the multiplier 213 is squared by means of the squarer 220 and added to a data value read out of the even register 221 by means of the adder 218. The sum is stored in the even register 221. The data values stored in the odd register 216 are called the odd subset of the normalized harmonic coefficients and the data values stored in the even register 221 are called the even subset of the normalized harmonic coefficients.

The compute mode is completed when the harmonic counter 205 is reset to its initial state at a maximum count of [N/2]=512. At this time an END signal is generated which is used to reset the flip-flop 297 thereby terminating the compute mode. The END signal is used to set the flip-flop 298. At the end of the compute mode the odd register 216 contains the values of $a_q^2$ of Eq. 2 and the even register 221 contains the values of $b_q^2$ of Eq. 3.

When flip-flop 298 is set at the end of the compute mode, a transfer mode of operation is initiated. During the transfer mode, the magnitude compute 223 utilizes the data stored in the odd register 216 and the even register to select the 16 peaks of the spectral function which correspond to the 16 harmonics of the signal output of the sound generator 201. The selected peak values are reduced to their corresponding square root values to produce the desired signal harmonic coefficients which are stored in the sound coefficient memory 224.

Figure 4:
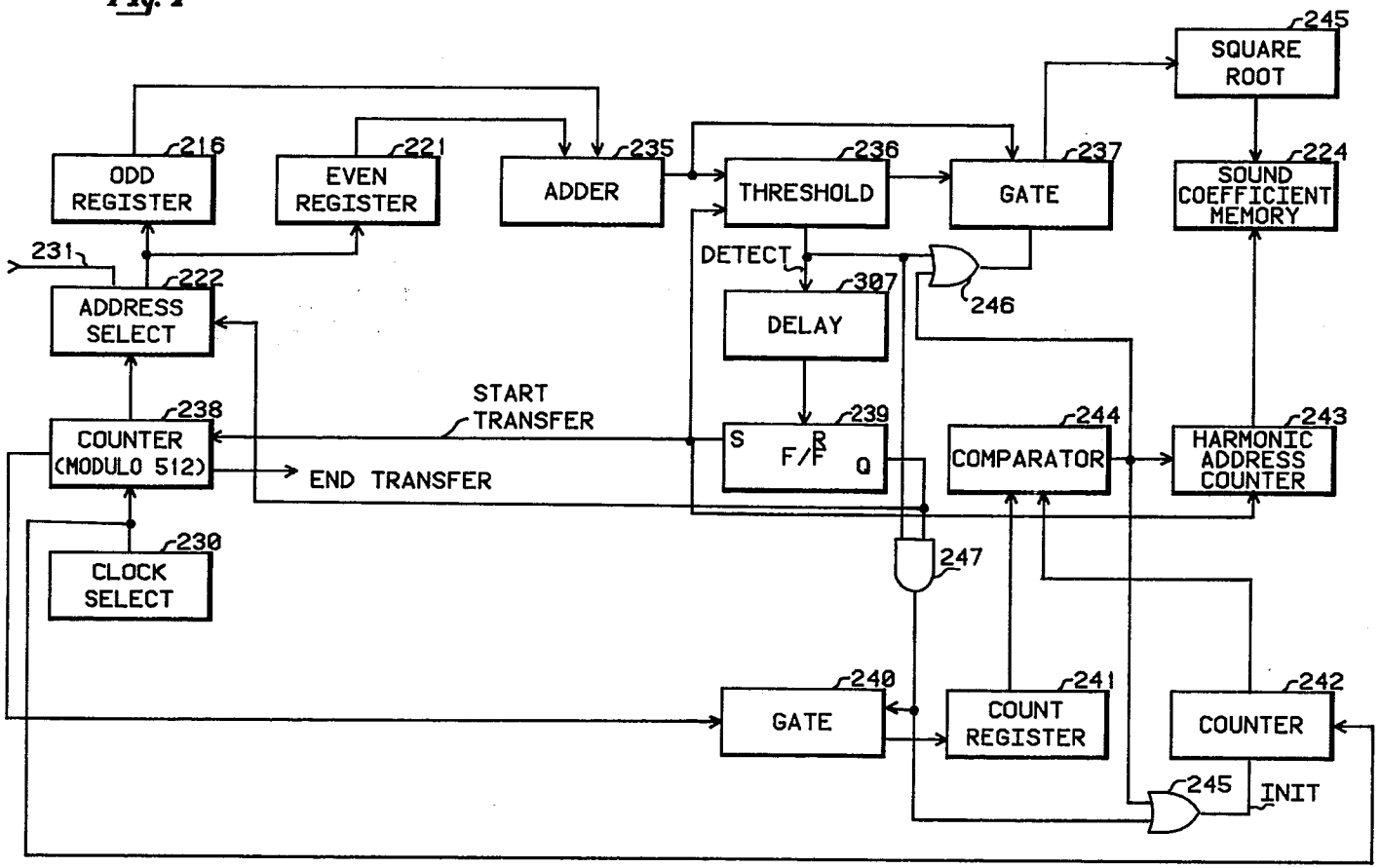
FIG. 4 is a schematic diagram of the magnitude compute of FIG. 2.

FIG. 4 illustrates the detailed system logic comprising the magnitude compute 223 shown in FIG. 2.

When flip-flop 298 is set, a START TRANSFER signal is generated which sets the flip-flop 239 thereby placing the system in the transfer mode. The START TRANSFER signal is also used to initialize the counter 238 and the harmonic address counter 243.

The count states of the counter 238 are incremented by the clock timing signals transferred by the clock select 230. In response to a Q="1" state from the flip-flop 239, the address select 222 transfer the count state of the counter 238. In response to a Q="0" state, the address select 222 transfers the count state from the counter 231. These count states are used to address out data values stored in the odd register 216 and the even register 221. The data values read out from the two registers are summed by means of the adder 235.

Figure 5:
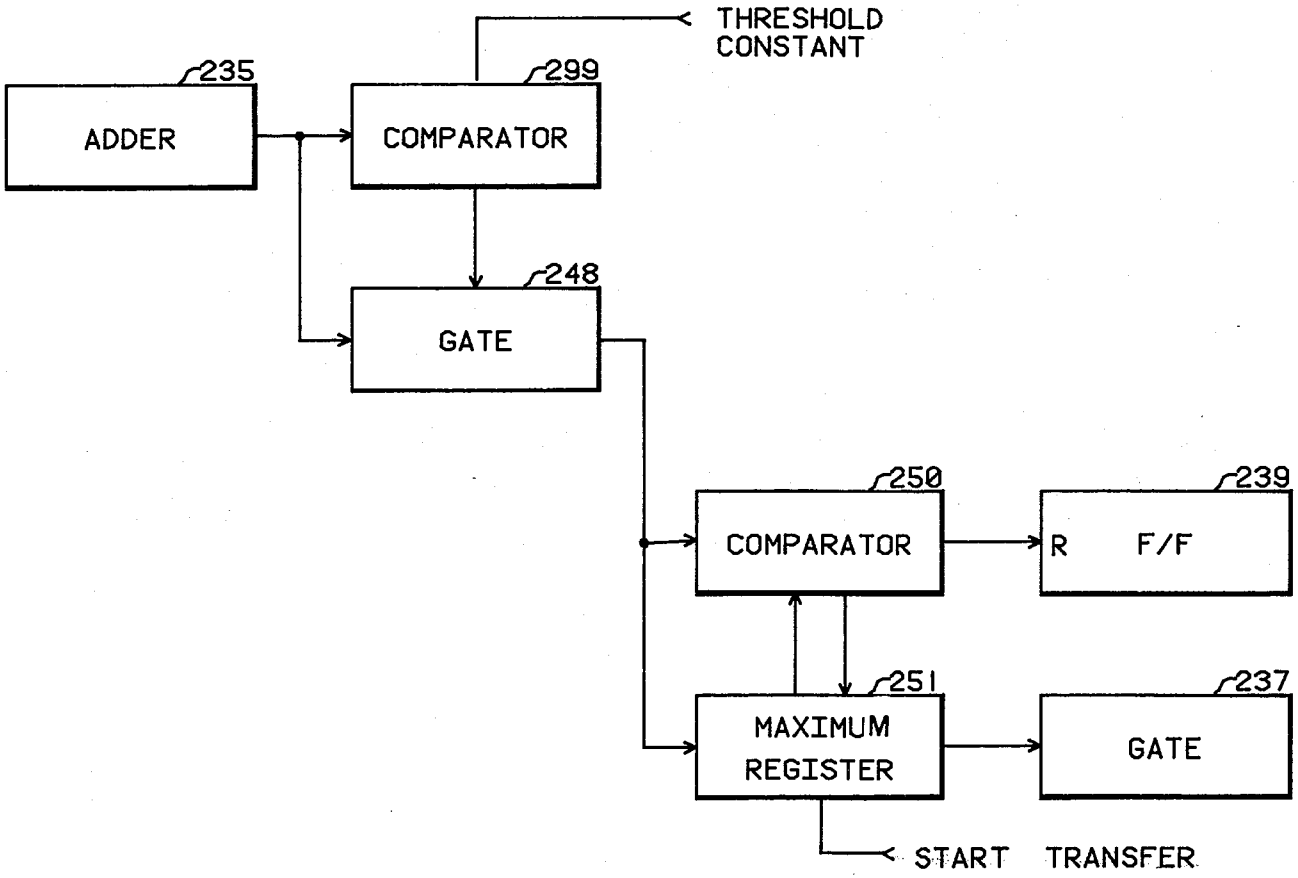
FIG. 5 is a schematic diagram of the threshold 236 shown in FIG. 4.

The summed output produced by the adder 235 is examined by the threshold 236 to find the first maximum of the summed data that exceeds a prespecified threshold magnitude level. The operation of the threshold 236 is described below with reference to the detailed logic shown in FIG. 5.

The sound generator 201 advantageously should have a peak reading device so that the signal produced by this generator can be set at some predetermined peak value. In this fashion, one can determine and specify a threshold magnitude level for the threshold 236 which will be less than the expected first maximum of the value of $c_q^2=a_q^2+b_q^2$ and yet be greater than the low frequency noise that occurs before the first maximum value. This noise is shown in FIG. 3.

When the first maximum of the output from the adder 235 is found, or detected, the threshold 236 generates a DETECT signal which is used to reset the flip-flop 239 after a delay produced by delay 307. When this DETECT signal is generated, AND-gate 247 will transmit a logic "1" signal to the gate 240. In response to this "1" signal, gate 240 will transfer the current count state of the counter 238 which is then stored in the count register 241. In this manner the count register 241 will contain the count, or the normalized harmonic number, corresponding to the first harmonic coefficient for the input tone.

The DETECT signal generated by threshold 236 when the first true maximum value is detected is transmitted to gate 237 via the OR-gate 246. In response to this signal, gate 237 will transfer the output from adder 235 to the square root 245. Square root 245 performs a square root operation on its input data value and the square root value is stored in the sound coefficient memory 224 at an address determined by the count state of the harmonic address counter 243.

Counter 242 is initialized by the signal transmitted by the AND-gate 247 via the OR-gate 245. The harmonic address counter 243 was initialized to its initial count state (corresponding to decimal value 1) by means of the START TRANSFER signal. In this fashion, the square root of the first maximum output from the adder 235 is stored in the sound coefficient memory 224 in its first memory address location.

The counter 242 is incremented by the same timing signals which are used to increment the count states of the counter 238. Comparator 244 compares the count state of the counter 242 with the number stored in the count register 241. When the comparator 244 finds that these two input values are equal, an EQUAL signal is generated. The EQUAL signal is used to increment the count state of the harmonic address counter 243. The EQUAL signal is transmitted via OR-gate 246 to the gate 237. In response to the EQUAL signal, gate 237 transmits the output from the adder 235 to the square root 245. The output from the square root 245 is stored in the sound coefficient memory 224 at a memory location corresponding to the count state of the harmonic address counter 243.

The EQUAL signal will reset the counter 242 to its initial count state so that the system is initialized to search for the next true harmonic coefficient of the input tone created by the sound generator 201. The preceding sequence of operations is repeated until all 512 data points have been addressed out from the odd register 216 and the even register 221. When all this data has been accessed, the data transfer mode is complete and the sound coefficient memory 224 will contain the 16 harmonic coefficients corresponding to the input tone from the sound generator 201. An END TRANSFER signal is generated by the counter 238 when it is incremented to its initial count state because of its implementation as a modulo 512 counter. The END TRANSFER signal is used to reset the flip-flop 298 shown in FIG. 2. first maximum of the output signals produced by the adder 235. The maximum register is set to a zero value by the START TRANSFER signal shown in FIG. 5. The comparator 299 compares the output data from the adder 235 with a prespecified threshold constant. If the current output data is greater in magnitude value than the threshold constant, the current output data is transferred via gate 248 to the comparator 250. Comparator 250 compares the data transferred by the gate 248 with the data stored in the maximum register 251. If the data from the gate 248 is greater in magnitude than the current data stored in the maximum register, the comparator 250 generates a write signal which causes the data output from the gate 248 to be stored in the maximum register 251. If the current data from the gate 248 is less than the data value stored in the maximum register 251, the comparator 250 generates a signal which resets the flip-flop 239. This signal denotes the detection of the first maximum of the output signals produced by the adder 235.

The purpose of the comparator 247 is to prevent the system from detecting a false first maximum of the data output from the adder 235 which could result from the noise-like low level data preceding the true first maximum. The value of the threshold constant is not critical and can easily be set at about one-half of the expected peak value for an input signal adjusted to a preselected peak level in the sound generator 201.

It is recognized that the exact peaks of the input analog signals are not always located by the described system. An error in location occurs because of the limited frequency resolution determined by the number of sample points stored in the sample shift register 203. For the preferred embodiment, the frequency resolution is 1/N. For example, for a tone having a fundamental pitch of $C_3$, the frequency resolution is $130\times16/1024=2$ Hz. Thus an error can occur in finding the true fundamental. This error is multiplied by the number of harmonics in locating each of the harmonics. Such errors are not critical because they manifest themselves only as errors in the magnitude of the measured harmonic coefficients. No objectionable noise is generated in the output musical tones as a consequence of the errors in the harmonic coefficients. Such errors only introduce relatively small variations in the generated tone color.

The system shown in FIG. 2 requires the following time intervals for the three operational modes previously described:

data acquisition mode:

$$T_A = 1024 \times (1/33488.1) = 30.6 \text{ milliseconds}$$

compute mode:

$$T_C = 1024 \times 512 \times 10^{-6} = 524.3 \text{ milliseconds}$$

transfer mode:

$$T_T = 512 \times 10^{-6} = 0.512 \text{ milliseconds}$$

The total time required is $T_A + T_C + T_T = 0.555$ seconds.

The time required to find the harmonic components for an input tone can be reduced if the fundamental frequency is known. One method of setting the tone at a given known pitch is to sound that note on the organ and then to sing at the audible pitch. As soon as the correct pitch has been sung, the organ key is released and the start key is actuated to initiate a data acquisition mode.

Figure 6:
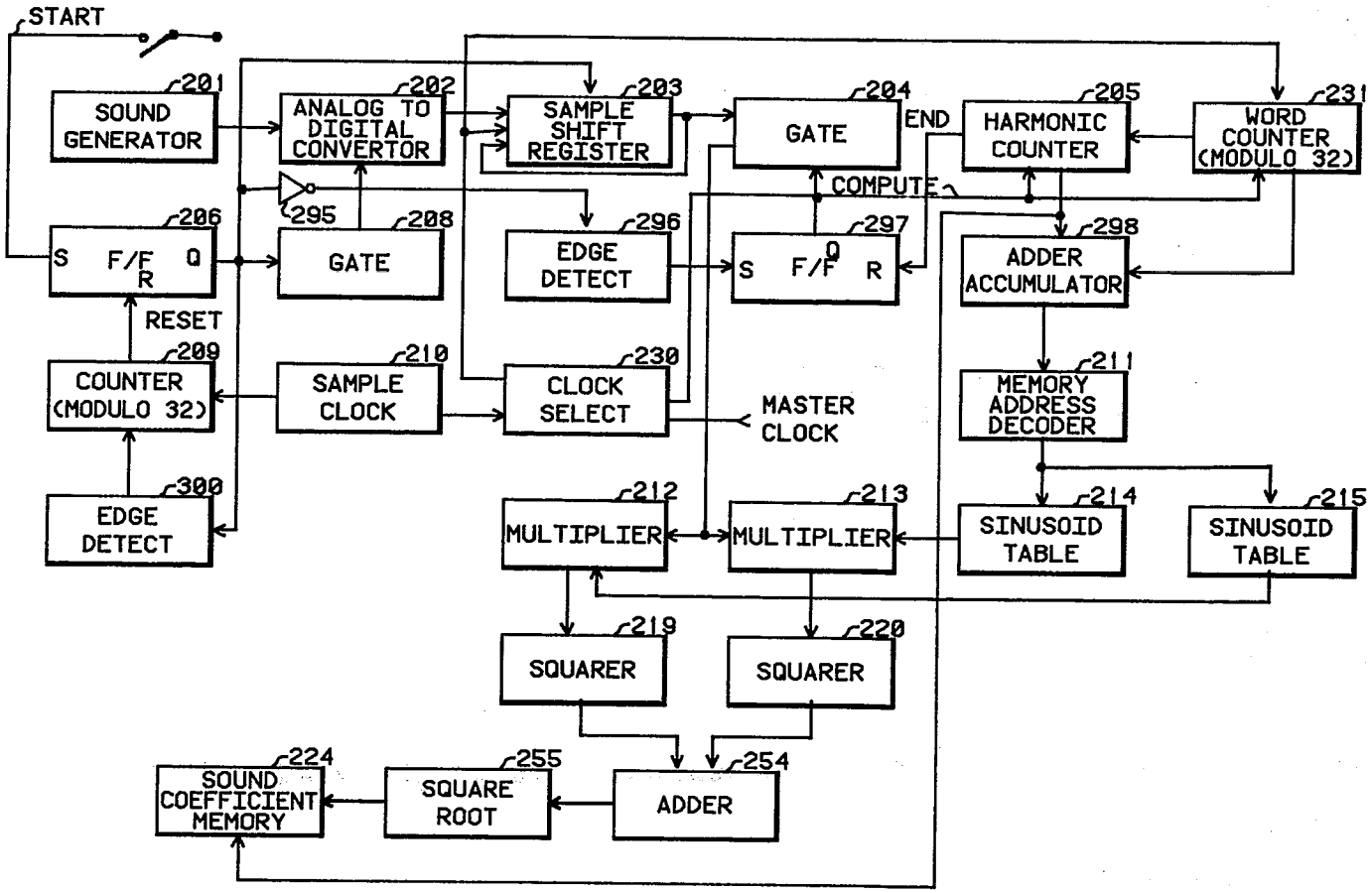
FIG. 6 is a schematic diagram of an alternative embodiment of the invention.

FIG. 6 shows an alternative embodiment of the present invention in which the signal created by the sound generator 201 is a periodic waveshape having a prespecified fundamental frequency. The sample clock 210 is operated at a frequency which is 32 times the fundamental frequency of the signal output from the sound generator 201. This frequency will accomodate the determination of 16 harmonics for the given signal.

The system elements shown in FIG. 6 operate in the same manner previously described for the system shown in FIG. 2 until the output data is reached for squarer 219 and squarer 220. The counter 209 and the counter 231 are now implemented to count modulo 32. The system shown in FIG. 6 has a data acquisition mode and a compute mode which operate in the manner already described for the system shown in FIG. 2. The system shown in FIG. 6 does not require a transfer mode to find the peaks of the normalized harmonic coefficients. In this case the normalized harmonic coefficients are identical to the signal's harmonic coefficients.

During the compute mode, the output data from the squarer 219 and squarer 220 are summed by means of the adder 254. The summed data is processed to find the square root of its magnitude by the square root 255 and the result is stored in the sound coefficient memory 224 at an address corresponding to the count state of the harmonic counter 205.

The system shown in FIG. 6 requires the following time intervals for the two operational modes for an input frequency at $A_4 = 440$ hz, data acquisition mode:

$$T_A = 32 \times 1/(440 \times 16 \times 2) = 2.27 \text{ milliseconds}$$

compute mode:

$$T_C = 32 \times 16 \times 10^{-6} = 0.512 \text{ milliseconds.}$$

The total required time to acquire and find the harmonic coefficients of the input tone is $T_A + T_C = 2.78$ milliseconds. In both the systems shown in FIG. 2 and FIG. 6, the logic clock rate used for the computations is set at 1 mhz. a priori knowledge of the fundamental frequency of the input tone can obviously be used to affect a large reduction in the time required to obtain the set of harmonic coefficients.

Figure 7:
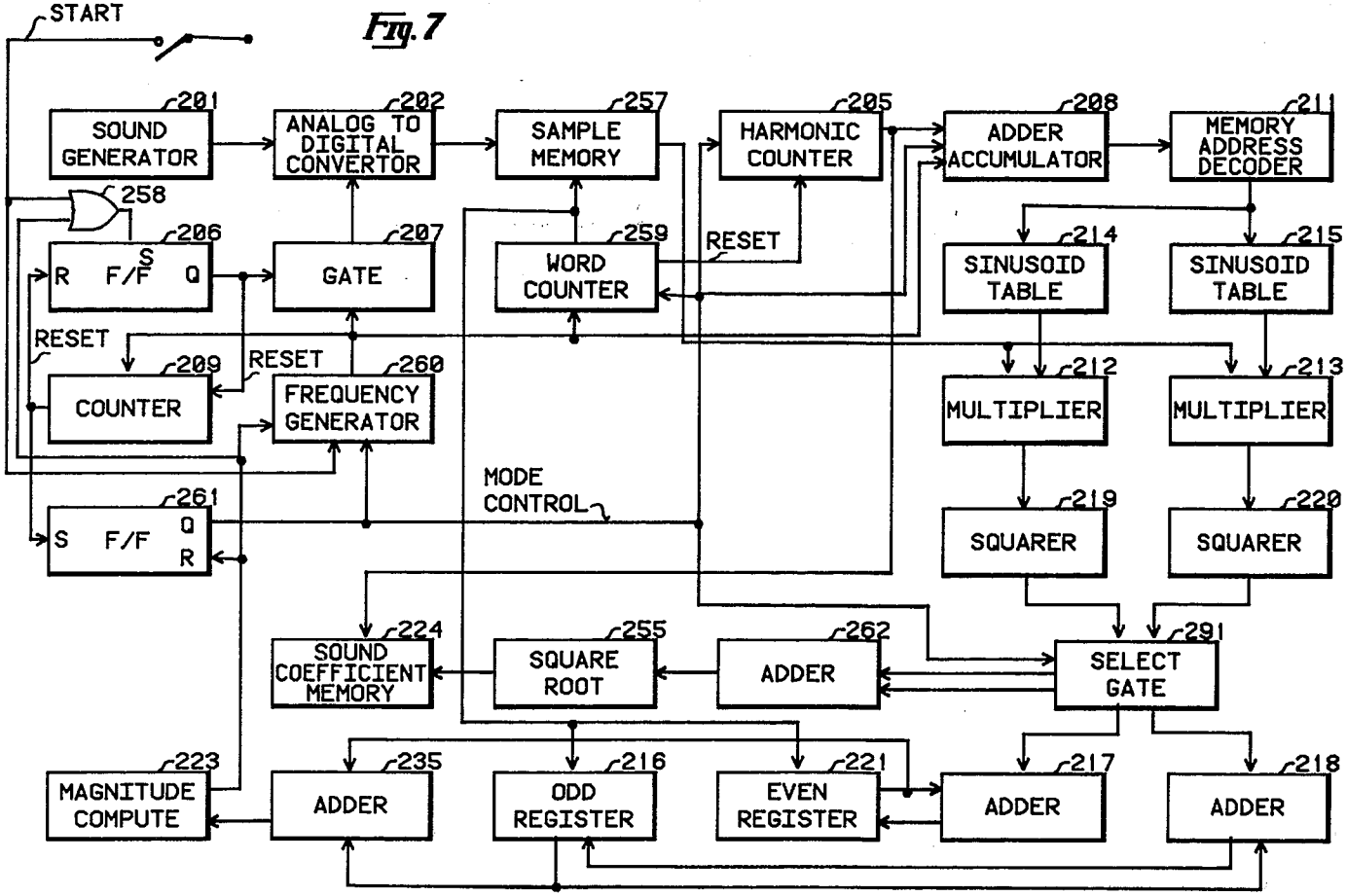
FIG. 7 is a schematic diagram of a second alternative embodiment of the invention.

Another alternative embodiment of the present invention is shown in FIG. 7. This system combines features of the systems shown in FIG. 2 and FIG. 6. A modification of the system shown in FIG. 2 is first employed to find the fundamental frequency of the input tone created by the sound generator 201. Once this frequency has been found, a system configuration similar to that shown in FIG. 6 can be employed to find the desired set of harmonic coefficients for the input time.

In response to the START signal, generated by closing the switch, the frequency generator 260 is set to generate a sequence of timing signals at a frequency of 33.49 khz. This sequence of timing signals is suitable for sampling a signal generated by the sound generator 201 in the range of about $C_3$ to $C_5$. The generated signal is presumed to have no more than 16 harmonics. The operation of the frequency generator 260 is described below.

Flip-flop 206 is set in response to the START signal. When flip-flop 260 is set, its output logic state of Q="1" will cause the counter 209 to be reset to its initial count state and at the same time counter 209 will be placed in a modulo 1024 counting mode. The generation of the START signal places the system in a frequency determination mode of operation.

In the frequency determination mode of operation, flip-flop 261 will not be set so that its output logic state is Q="0". This output state is called the MODE CONTROL signal. In response to a "0" state MODE CONTROL signal, the word counter 259 is caused to count modulo 1024.

When the counter 209 reaches its maximum count of 1024 and is reset because of its modulo counting implementation, a RESET signal is generated. This RESET signal will reset the flip-flop 206 and it will set the flip-flop 261. This action causes the MODE CONTROL signal to be in a logic "1" state. At this time, the sample memory 257 will contain 1024 consecutive sample points derived from the signal output from the sound generator 201 which is converted to digital values by means of the analog-to-digital converter 202.

When the MODE CONTROL signal is a logic "1", a frequency compute mode of operation is initiated as part of the frequency mode of operation. During the frequency compute mode, a discrete Fourier transform is implemented using the data stored in the sample memory 257 to compute the first 32 harmonics of the normalized frequency $f_N = 1/1024$. The fourier transform operation during the frequency determination mode functions in the manner previously described for the system shown in FIG. 2.

The harmonic counter 205 and the word counter 259 are initialized to their initial count state at the start of the frequency determination mode in response to a transition to a "1" state for the MODE CONTROL signal.

The word counter 259 is incremented by the timing signals generated by the frequency generator 260. The stored data points in the sample memory 257 are read in sequence each time that the count state of the word counter 259 is incremented. Each time the word counter 259 is incremented to its initial state because of its modulo counting action, a RESET signal is generated which is used to increment the count state of the harmonic counter 205.

The adder-accumulator 208 successively adds the count state of the harmonic counter 205 to itself in response to changes in the count state of the word counter 259. The adder-accumulator 208 is initialized by the MODE CONTROL signal at the state of a frequency compute mode of operation.

The memory address decoder 211 is used to address data from the sinusoid tables 214 and 215 in response to the contents of the adder-accumulator 208. Multiplier 212 provides the product of the sinusoid value read out of the sinusoid table 214 and the signal data value read out of the sample memory 257. Multiplier 213 provides the product of the sinusoid value read out of the sample memory 257. The product data value from the multiplier 212 is squared in magnitude by means of the squarer 219 and the product data value from the multiplier 213 is squared in magnitude by means of the squarer 220. When the MODE CONTROL signal has a logic state "1" during thee frequency compute mode, the select gate 291 transfers the output of the squarer 219 to the adder 217 and it transfers the output of the squarer 220 to the adder 218.

The data value transferred by the select gate 291 from the squarer 219 is added by means of adder 217 to the contents of the even register 221 read out in response to the count state of the word counter 259. The data value transferred by select gate 291 from the squarer 220 is added by means of adder 218 to the contents of the odd register 216 read out in response to the count state of the word counter 259.

As data is written into the odd register 216 and the even register 221, the two data values are summed by means of adder 235. The data values are stored at memory addresses corresponding to the count state of the word counter 259. The output of the adder 235 is processed by the magnitude compute 223 as previously described with reference to FIG. 4. In this case the MODE CONTROL is used for the STATE TRANSFER SIGNAL shown in FIG. 4. Also for the system shown in FIG. 7, the counter 242 is made to count modulo 1 as only the first harmonic coefficient is required. It is noted that during the frequency compute mode, a Fourier transform is used only to find the location of the first harmonic peak of the normalized harmonic coefficients as measured in units of the normalized frequency of 1/1024.

The END TRANSFER signal, generated by the counter 238 of FIG. 4, is used to reset the flip-flop 261 thereby placing the MODE CONTROL signal in a "0" binary state. The END TRANSFER signal is also used to set the flip-flop 206 thereby placing the system in a compute mode.

During the compute mode, or harmonic data compute mode, the "0" state of the MODE CONTROL causes the word counter 256 to count modulo 32, the counter 209 to count modulo 32, and the harmonic counter 205 to count modulo 16.

In a manner analogous to the system operation during the frequency determination mode, 32 equally spaced samples of the signal output the sound generator 201 are converted to digital values by means of the analog-to-digital converter 202 and stored in the sample memory 257. In a manner described below with reference to FIG. 8, the frequency generator 260 is set to approximately 32 times the fundamental frequency of the signal output from the sound generator 201.

The system operation during the harmonic data compute mode is analogous to the operation during the frequency determination mode up to the select gate 291 in the signal processing system. It is noted that in the harmonic data compute mode, the harmonic counter 205 counts modulo 16 while the word counter 259 counts modulo 32. In this fashion all 16 harmonics of the input signal are determined.

The "0" state of the MODE CONTROL causes the select gate 291 to transfer the output values from the squarers 219 and 220 to the adder 262. Adder 262 sums the two input data values and the square root of the summed output is evaluated by the square root 255.

The output from the square root is stored in the sound coefficient memory at a memory location corresponding to the state of the harmonic counter 205.

Figure 8:
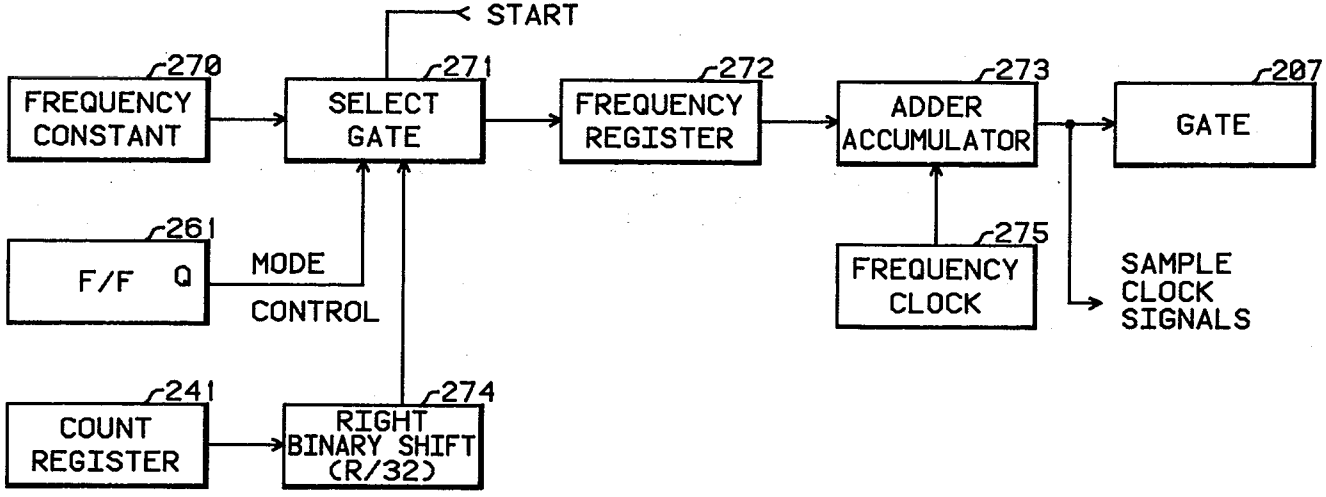
FIG. 8 is a schematic diagram of the frequency generator of FIG. 7.

FIG. 8 illustrates the subsystem logic comprising the frequency generator 260 shown in FIG. 7. In response to the START signal, select gate 271 will transfer a frequency constant value stored in the frequency constant 270 and store the transferred value in the frequency register 272. Advantageously the frequency constant is equal to the binary equivilant of a decimal one value. The frequency number stored in the frequency register 272 is repeatedly added to the contents of the adder-accumulator 273 at a rate determined by the frequency clock 275. The frequency clock 275 is operated at the data sampling frequency of 33.49 khz. The accumulator in the adder-accumulator 273 will reset to its initial value when the binary equivalent of decimal one is reached. The net result is that during the data acquisition mode, the reset signals generated by the adder accumulator 273 will be a sequence of sample clock signals at a frequency of 33.49 khz.

The location of the first harmonic of the sample tone analyzed during the frequency determination mode is stored in the count register 241 in the manner previously described with reference to FIG. 4. The number stored in the count register 241 is divided by 32 by means of the right binary shift 274. During the data acquisition mode when the MODE CONTROL signal is in its binary state "1", the select gate 271 transfers the output of the right binary shift 274 to be stored in the frequency register 272. In this fashion the sample clock signals generated during the data acquisition mode have a frequency which is essentially equal to 32 times the fundamental frequency of the signal output from the sound generator 201.

The total analysis time required for the system shown in FIG. 7 is composed of the time required for the various operational modes:

frequency acquisition mode:

$$T_{FA}=1024\times(1/33{,}490)=30.6 \text{ milliseconds}$$

frequency determination mode:

$$F_F=1024\times 32\times 10^{-1}=32.8 \text{ milliseconds}$$

second data acquisition mode for a tone at $C_3$:

$$T_S=32\times(1/130.81)=245 \text{ milliseconds}$$

computation mode:

$$T_C=32\times 16\times 10^{-6}=0.51 \text{ milliseconds.}$$

The total analysis time is $T_T=T_{FA}+T_F+T_S+T_C=0.308$ seconds. Thus the reduction in the time required to obtain the set of 16 harmonic coefficients for the system shown in FIG. 8 is about one half of the time required for the system shown in FIG. 2. It should be noted that a time delay of about 0.5 seconds is not usually considered to be objectionable for the time required to change tones in a musical system. For example, piston changes which alter the tones in a pipe organ combination system usually required about 0.5 seconds to complete a switching action after a controlling switch is actuated.

The frequency resolution of the subsystem shown in FIG. 7 to find the frequency of the signal output from the sound generator 201 is $f_R=33{,}490/(1024\times16)=2$ Hz. The frequency difference between the two highest notes in the input frequency range is that between the notes $C_5$ and $B_4$. This is a frequency difference of 29.4 hz. The frequency resolution can be increased by increasing the size N of the number of data samples stored in the sample memory 257 which are used in the frequency determination mode. A doubling of the data size N will halve the frequency resolution as measured in Hertz.

The present invention is also applicable to other tone generation systems in which the output musical waveshapes are generated by implementing a Fourier-type transformation. The generated tones being determined by a preselected set of harmonic coefficients. Such a tone generating system is described in U.S. Pat. No. 3,809,786 entitled "Computor Organ." This patent is hereby incorporated by reference.

Figure 9:
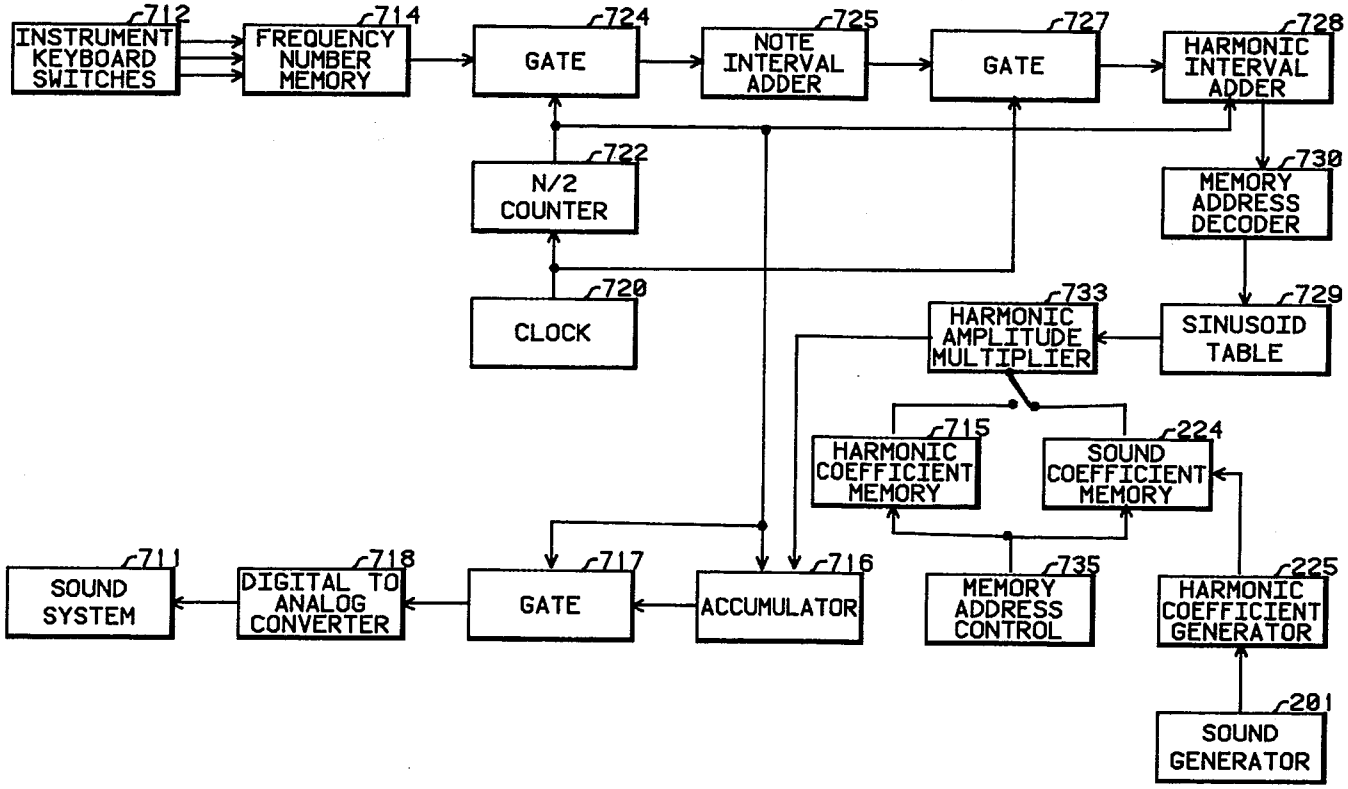
FIG. 9 is a schematic diagram of an embodiment of the invention combined with a Computor Organ system.

FIG. 9 illustrates the combination of the present invention with a tone generation system described in U.S. Pat. No. 3,809,786. The system logic blocks having a "700" series label correspond to the system logic blocks in FIG. 1 of the reference patent having a number 700 less than the label used in the present FIG. 9. The added subsystem comprises the system logic blocks 224, 225, and 201 whose operation has been previously described.

We claim:

1. In a keyboard musical instrument having a number of tone generators, in which a plurality of data words corresponds to the amplitudes of the points defining the waveform of a musical tone are computed and transferred sequentially to a digital-to-analog converter to be converted into musical waveshapes, apparatus for generating tones imitative of a musical signal tone comprising;

a coefficient memory for storing a set of harmonic coefficient values;

a sound generator for generating said musical signal tone, a harmonic coefficient computing means responsive to said musical signal tone wherein a said set of harmonic coefficient values are created, a first addressing means whereby the set of harmonic coefficient values created by said harmonic coefficient computing means is stored in said coefficient memory, a means for computing, responsive to the set of harmonic coefficient values stored in said coefficient memory, whereby said plurality of data words corresponding to the amplitudes of points defining the waveform of a musical tone are computed, and means for producing musical waveshapes from said plurality of data words thereby generating said tones which are imitative of said musical signal tone.

2. In a musical instrument according to claim 1 wherein said sound generator comprises a sound transducer for converting an acoustic signal to an electrical signal.

3. In a musical instrument according to claim 1 wherein said harmonic coefficient computing means comprises;

a clock for providing a sequence of timing signals, a conversion means, responsive to said sequence of timing signals, whereby said musical signal tone is converted to a sequence of binary digital numbers comprising a signal tone sample data set, and a sample memory for storing said signal tone sample data set.

4. In a musical instrument according to claim 3 wherein said conversion means comprises;

a means for generating a start signal, a sample counter incremented by said sequence of timing signals and wherein said sample counter counts modulo a predetermined number N, initializing circuitry responsive to said start signal whereby said sample counter is reset to an initial count state, and a sample modulo reset circuitry whereby a compute signal is created when said sample counter returns to its initial state.

5. In a musical instrument according to claim 4 wherein said harmonic coefficient computing means further comprises;

a coefficient computing means responsive to the signal tone sample data set stored in said sample memory whereby a set of normalized harmonic coefficients are computed, and a magnitude compute means whereby said set of harmonic coefficient values are selected from said set of normalized coefficients and provided to said first addressing means.

6. In a musical instrument according to claim 5 wherein said coefficient computing means comprises;

a word counter incremented by said sequence of timing signals and wherein said word counter counts modulo said predetermined number N, word initializing circuitry, responsive to said compute signal, whereby said word counter is reset to an initial count state, word modulo reset circuitry whereby a word reset signal is created when said word counter returns to its initial state, a harmonic counter, incremented by said word reset signal, wherein said harmonic counter counts modulo the greatest integer value not exceeding one-half of said predetermined number N, harmonic initializing circuitry, responsive to said compute signal, whereby said harmonic counter is reset to an initial count state, harmonic modulo reset circuitry whereby an end signal is created when said harmonic counter returns to its initial state, an adder-accumulator means, initialized in response to said word reset signal, for successively adding the contents of said harmonic counter to itself in response to changes in the state of said word counter and storing the resultant sum, a first sinusoid table storing values of trigonometric sine functions, a second sinusoid table storing values of trigonometric cosine functions, a sinusoid table addressing means for reading a trigonometric sine value from said first sinusoid table and for reading out a trigonometric cosine value from said second sinusoid table in response to said resultant sum stored in said adder-accumulator means, an odd memory means for storing data to be thereafter read out, an even memory means for storing data to be thereafter read out, a sample memory addressing means responsive to said sequence of timing signals for reading a signal tone sample data set value from said sample memory, a first multiplier means for generating the multiplied product of said signal sample data set value read out from said sample memory and said trigonometric sine value read out from said first sinusoid table, a first squarer means whereby a first squared value is generated by multiplying by itself said multiplied product generated by said first multiplier means, a first means for successively algebraically summing said first squared value with a data value read out of said odd memory means in response to contents of said word counter to form an odd summed value, an odd addressing means responsive to contents of said word counter whereby said odd summed value is stored in said odd memory means thereby creating an odd subset of said normalized harmonic coefficients, a second multiplier means for generating the multiplied product of said signal sample data set value read out from said sample memory and said trigonometric cosine value read out from said second sinusoid table, a second squarer means whereby a second squared value is generated by multiplying by itself said multiplied product generated by said second multiplier means, a second means for successively algebraically summing said second squared value with a data value read out of said even memory means in response to contents of said word counter to form an even summed value, and an even addressing means responsive to contents of said word counter whereby said even summed value is stored in said even memory means thereby creating an even subset of said normalized harmonic coefficients.

7. In a musical instrument according to claim 6 wherein said magnitude compute means comprises;

a register counter incremented by said sequence of timing signals and wherein said register counter counts modulo the greatest integer value not exceeding one-half of said predetermined number N, register initializing circuitry, responsive to said end signal, whereby said register counter is reset to an initial count state, a register addressing means, responsive to the contents of said register counter, whereby an odd normalized harmonic coefficient is read out from said odd memory means and whereby an even normalized harmonic coefficient is read out from said even memory means, an adder means for forming a summed normalized harmonic coefficient by summing said read out odd normalized harmonic coefficient with said read out even normalized harmonic coefficient, a count register for storing a count state to be thereafter read out, a threshold comparison means whereby signal is generated if said summed normalized harmonic coefficient formed by said adder means has a maximum value greater than a prespecified threshold value, count transfer circuitry responsive to said threshold signal for storing the count state of said register counter in said count register, a select counter incremented by said sequence of timing signals and wherein said select counter is reset to an initial state in response to a count equal signal, a count comparison means whereby said count equal signal is generated if the count state of said select counter is equal to the count state stored in said count register, a harmonic address counter incremented by said count equal signal and wherein said harmonic address counter is reset to an initial state in response to said end signal, square root means for evaluating the square root magnitude of an input data value, and a coefficient select gate responsive to said count equal signal for transferring said summed normalized harmonic coefficient to said square root means.

8. In a musical instrument according to claim 7 wherein said first addressing means comprises;

addressing circuitry whereby the square root magnitude evaluated by said square root means is stored in said coefficient memory at an address corresponding to the count state of said harmonic address counter.

9. In a keyboard musical instrument having a number of tone generators, in which a plurality of data words corresponding to the amplitudes of points defining the waveform of a musical tone are computed and transferred sequentially to a digital-to-analog converter to be converted into musical waveshapes, apparatus for generating tones imitative of a musical signal tone comprising;

a coefficient memory for storing a set of harmonic coefficient values, a sound generator for generating said musical signal tone, a variable frequency clock means for generating a sequence of timing signals, a tuning means responsive to said musical tone whereby said variable frequency clock means is caused to operate at a frequency corresponding to the pitch of said musical tone, a harmonic coefficient computing means, responsive to said sequence of timing signals, whereby said set of harmonic coefficient values are created, a first addressing means whereby the set of harmonic coefficient values created by said harmonic coefficient computing means is stored in said coefficient memory, a means for computing, responsive to the set of harmonic coefficient values stored in said coefficient memory whereby said plurality of data words corresponding to the amplitudes of points defining the waveform of a musical tone are computed, and a means for producing musical waveshapes from said plurality of data words thereby generating said tones which are imitative of said musical signal tone.

10. In a musical instrument according to claim 9 wherein said harmonic coefficient computing means comprises;

a conversion means, responsive to said sequence of timing signals, whereby said musical signal tone is converted to a set containing a number of N binary digital numbers comprising a signal tone sample data set corresponding to a period of said musical sigal tone, and a sample memory for storing said signal tone sample data set.

11. A musical instrument according to claim 10 wherein said conversion means comprises;

a means for generating a start signal, a sample counter incremented by said sequence of timing signals and wherein said sample counter counts modulo said number N, initializing circuitry, responsive to said start signal, whereby said sample counter is reset to an initial count state, and a sample modulo reset circuitry whereby a compute signal is created when said sample counter returns to its initial state.

12. A musical instrument according to claim 11 wherein said harmonic coefficient computing means comprises;

a word counter incremented by said sequence of timing signals and wherein said word counter counts modulo said number N, word initializing circuitry, responsive to said compute signal, whereby said word counter is reset to an initial count state, word modulo reset circuitry whereby a word reset signal is created when said word counter returns to its initial state, a harmonic counter, incremented by said word reset signal, wherein said harmonic counter counts modulo the greatest integer value not exceeding one-half of said number N, harmonic initializing circuitry, responsive to said compute signal, whereby said harmonic counter is reset to an initial count state, harmonic modulo reset circuitry whereby an end signal is created when said harmonic counter returns to its initial state, an adder-accumulator means, initialized in response to said word reset signal, for successively adding the contents of said harmonic counter to itself in response to changes in the state of said word counter and storing the resultant sum, a first sinusoid table storing values of trigonometric sine functions, a second sinusoid table storing values of trigonometric cosine functions, a sinusoid table addressing means, responsive to said resultant sum stored in said adder-accumulator means, for reading out a trigonometric sine value from said first sinusoid table and for reading out a trigonometric cosine value from said second sinusoid table, a sample memory addressing means, responsive to said sequence of timing signals, for reading out a signal tone sample data set value from said sample memory, a first multiplier means for generating the multiplied product of said signal tone sample data set value read out of said sample memory by said trigonometric sine value read out from said first sinusoid table, a first squarer means whereby a first squared value is generated by multiplying by itself said multiplied product generated by said first multiplier means, a second multiplier means for generating the multiplied product of said signal tone sample data set value read out of said sample memory by said trigonometric cosine value read out from said second sinusoid table, a second squarer means whereby a second squared value is generated by multiplying by itself said multiplied producted generated by said second multiplier means, an adder means for adding said first squared value and said second squared value to form a summed value, and a square root means for generating a harmonic coefficient corresponding to the square root magnitude of said summed value.

13. A musical instrument according to claim 12 wherein said first addressing means comprises;

addressing circuitry whereby said harmonic coefficient generated by said square root means is stored in said coefficient memory at an address corresponding to the count state of said harmonic counter.

14. In a keyboard musical instrument having a number of tone generators, in which a plurality of data words corresponding to the amplitudes of points corresponding to the amplitudes of points defining the waveform of a musical tone are computed and transferred sequentially to a digital-to-analog converter to be converted into musical waveshapes, apparatus for generating tones imitative of a musical signal tone comprising;

a coefficient memory for storing a set of harmonic coefficient values, a sound generator for generating said musical signal tone, a computing means operative in a frequency determination mode during which the fundamental frequency of said musical signal tone is determined and operative in a harmonic data compute mode during which said set of harmonic coefficient values are created, a first addressing means whereby the set of harmonic coefficient values created during said harmonic data compute mode is stored in said coefficient memory, a means for computing, responsive to the set of harmonic coefficient values stored in said coefficient memory whereby said plurality of data words corresponding to the amplitudes of points defining the waveform of a musical tone are computed, and a means for producing musical waveshapes from said plurality of data words thereby generating said tones which are imitative of said musical signal tone.

15. In a musical instrument according to claim 14 wherein said computing means comprises;

a variable frequency clock means for generating a sequence of timing signals, a frequency determination means, operative during said frequency determination mode, for generating a frequency number corresponding to the pitch of said musical signal tone, a frequency setting means whereby said variable frequency clock means is operated at a frequency corresponding to a frequency N times said frequency number during said harmonic data compute mode and whereby said variable frequency clock means is operated at a preselected frequency M during said frequency determination mode, a conversion means, responsive to said sequence of timing signals, whereby said musical tone is converted to a sequence of binary digital numbers comprising a signal tone sample data set, and a sample memory for storing said signal tone sample data set.

16. In a musical instrument according to claim 15 wherein said conversion means comprises;

a means for generating a start signal, a means for generating a mode control signal having a binary logic state "0" in response to said start signal and having a state "1" in response to a detect signal, a mode control means responsive to said mode control signal, whereby said frequency determination mode is operative if the mode control signal is in state "0" and whereby said harmonic data compute mode is operative if the mode control signal is in state "1", a sample counter incremented by said sequence of timing signals wherein said sample counter counts modulo a predetermined nubmer P during said frequency determination mode and wherein said sample counter counts modulo said number N during said harmonic data compute mode, initializing circuitry, responsive to said start signal or to said detect signal, whereby said sample counter is reset to an initial count state, and a sample modulo reset circuitry whereby a compute signal is created when said sample counter returns to its initial state.

17. In a musical instrument according to claim 16 wherein said computing means further comprises;

a word counter incremented by said sequence of timing signals wherein said word counter counts modulo said number P during said frequency determination mode and wherein said word counter counts modulo said number N during said harmonic data compute mode, word initializing circuitry, responsive to said compute signal, whereby said word counter is reset to an initial count state, word modulo reset circuitry whereby a word reset signal is created when said word counter returns to its initial count state, a harmonic counter, incremented by said word reset signal, wherein said harmonic counter counts modulo 1 during said frequency determination mode and wherein said harmonic counter counts modulo the greatest integer value not exceeding one-half of said number N during said harmonic data computation mode, harmonic initializing circuitry, responsive to said compute signal, whereby said harmonic counter is reset to an initial count state, harmonic modulo reset circuitry whereby an end signal is created when said harmonic counter returns to its initial state, an adder-accumulator means initialized in response to said word reset signal, for successively adding to itself and storing the contents of said harmonic counter in response to changes in the state of said word counter, a first sinusoid table storing values of trigonometric sine functions, a second sinusoid table storing values of trigonometric cosine functions, a sample memory addressing means, responsive to said sequence of timing signals, for reading a signal tone sample data set value from said sample memory, a sinusoid table addressing means for reading out a trigonometric sine value from said first sinusoid table and for reading out a trigonometric cosine value from said second sinusoid table in response to contents stored in said adder-accumulator means, a first multiplier means for generating the multiplied product of said signal sample data set value and said trigonometric sine value read out from said first sinusoid table, a first squarer means whereby a first squared value is generated by multiplying by itself said multiplied product generated by said first multiplier means, a second multiplier means for generating the multiplied product of said signal sample data set value and said trigonometric cosine value read out from said second sinusoid table, a second squarer means whereby a second squared value is generated by multiplying by itself said multiplied product generated by said second multiplier means, a harmonic coefficient computing means, and a data select means whereby said first squared value and said second squared value are transferred to said frequency determination means during said frequency determination mode and whereby such first squared value and said second squared value are transferred to said harmonic coefficient computing means during said harmonic data compute mode.

18. In a musical instrument according to claim 17 wherein said frequency determination means comprises;

an odd memory means for storing data to be thereafter read out, an even memory means for storing data to be thereafter read out, an odd addressing means responsive to contents of said word counter, whereby said first squared value transferred by said data select means is stored in said odd memory means, an even addressing means, responsive to contents of said word counter, whereby said second squared value transferred by said data select means is stored in said even memory means, and a maximum amplitude means for determining the common address location of said odd memory means and said even memory means containing first and second squared values corresponding to the fundamental frequency of said musical signal tone.

19. In a musical instrument according to claim 18 wherein said maximum amplitude means comprises;

a register counter incremented by said sequence of timing signals, a register addressing means, responsive to contents of said register counter, for reading out a data value from said odd memory means and a data value from said even memory means, an adder for summing the data value read out from said odd memory means and the data value read out from said even memory means to form a summed value, a maximum detect means whereby said detect signal is generated when said summed value has a maximum value greater than some preselected threshold value, and a divider means, responsive to said detect signal, for dividing the contents of said register counter by said number N thereby generating said frequency number.

20. In a musical instrument according to claim 17 wherein said harmonic coefficient means comprises;

a second adder for summing said first squared value transferred by said data select means with said second squared value transferred by said data select means to form a squared sum value, and a square root means for generating a harmonic coefficient corresponding to the square root magnitude of said squared sum value.

21. In a musical instrument according to claim 20 wherein said first addressing means comprises;

addressing circuitry whereby said harmonic coefficient generated by said square root means is stored in said coefficient memory at an address corresponding to the count state of said harmonic counter.

* * * * *

UNITED STATES PATENT AND TRADEMARK OFFICE

CERTIFICATE OF CORRECTION

PATENT NO. : 4,385,542

DATED : May 31, 1983

INVENTOR(S) : Ralph Deutsch and Leslie J. Deutsch

It is certified that error appears in the above-identified patent and that said Letters Patent are hereby corrected as shown below:

Column 3, line 68 change "$c_3$" to --$C_3$--.

Column 13, line 43 change "corresponds" to --corresponding--.

Column 13, line 64 change "means" to --a means--.

Column 16, line 5 after "whereby" insert --a threshold--.

Column 19, line 27 change "nubmrt" to --number--.

Signed and Sealed this

*Twenty-sixth* Day of *July 1983*

[SEAL]

*Attest:*

GERALD J. MOSSINGHOFF

*Attesting Officer*

*Commissioner of Patents and Trademarks*